US008431306B2

(12) United States Patent
Sacripante et al.

(10) Patent No.: US 8,431,306 B2
(45) Date of Patent: Apr. 30, 2013

(54) POLYESTER RESIN CONTAINING TONER

(75) Inventors: Guerino G. Sacripante, Oakville (CA); Daryl W. Vanbesien, Burlington (CA); Biritawit Asfaw, Oakville (CA); Rosa M. Duque, Brampton (CA); Sonja Hadzidedic, Oakville (CA)

(73) Assignee: Xerox Corporation, Norwalk, CT (US)

( * ) Notice: Subject to any disclaimer, the term of this patent is extended or adjusted under 35 U.S.C. 154(b) by 492 days.

(21) Appl. No.: 12/720,038

(22) Filed: Mar. 9, 2010

(65) Prior Publication Data

US 2011/0223525 A1 Sep. 15, 2011

(51) Int. Cl.
*G03G 9/00* (2006.01)

(52) U.S. Cl.
USPC ..... 430/110.2; 430/109.1; 430/109.4

(58) Field of Classification Search ..... 430/109.1, 430/109.4, 110.2
See application file for complete search history.

(56) References Cited

U.S. PATENT DOCUMENTS

| | | | |
|---|---|---|---|
| 3,590,000 | A | 6/1971 | Palermiti et al. |
| 3,655,374 | A | 4/1972 | Palermiti et al. |
| 3,720,617 | A | 3/1973 | Chatterji et al. |
| 3,800,588 | A | 4/1974 | Larson et al. |
| 3,847,604 | A | 11/1974 | Hagenbach et al. |
| 3,983,045 | A | 9/1976 | Jugle et al. |
| 4,265,660 | A | 5/1981 | Giflo |
| 4,295,990 | A | 10/1981 | Verbeek et al. |
| 4,298,672 | A | 11/1981 | Lu |
| 4,338,390 | A | 7/1982 | Lu |
| 4,935,326 | A | 6/1990 | Creatura et al. |
| 4,937,166 | A | 6/1990 | Creatura et al. |
| 5,236,629 | A | 8/1993 | Mahabadi et al. |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,330,874 | A | 7/1994 | Mahabadi et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,593,807 | A | 1/1997 | Sacripante et al. |
| 5,650,255 | A | 7/1997 | Ng et al. |
| 5,650,256 | A | 7/1997 | Veregin et al. |
| 5,686,218 | A | 11/1997 | Liebermann et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,977,210 | A | 11/1999 | Patel et al. |
| 5,994,020 | A | 11/1999 | Patel et al. |
| 6,020,101 | A | 2/2000 | Sacripante et al. |
| 6,120,967 | A | 9/2000 | Hopper et al. |
| 6,130,021 | A | 10/2000 | Patel et al. |
| 6,214,507 | B1 | 4/2001 | Sokol et al. |
| 6,628,102 | B2 | 9/2003 | Batson |
| 6,664,015 | B1 | 12/2003 | Sacripante et al. |
| 6,780,560 | B2 | 8/2004 | Farrugia et al. |
| 6,818,723 | B2 | 11/2004 | Sacripante |
| 6,826,944 | B1 | 12/2004 | Hagel |
| 6,830,860 | B2 | 12/2004 | Sacripante et al. |
| 6,849,371 | B2 | 2/2005 | Sacripante et al. |
| 7,208,253 | B2 | 4/2007 | Mayer et al. |
| 7,329,476 | B2 | 2/2008 | Sacripante et al. |
| 7,390,605 | B2 * | 6/2008 | Shirai ..... 430/109.4 |
| 7,402,371 | B2 | 7/2008 | Sacripante et al. |
| 7,416,827 | B2 | 8/2008 | Farrugia et al. |
| 7,425,398 | B2 | 9/2008 | Nosella et al. |
| 7,442,740 | B2 | 10/2008 | Patel et al. |
| 7,541,423 | B2 | 6/2009 | DeBruin |
| 2006/0216626 | A1 | 9/2006 | Sacripante et al. |
| 2008/0107989 | A1 | 5/2008 | Sacripante et al. |
| 2008/0107990 | A1 | 5/2008 | Field et al. |
| 2008/0182193 | A1 * | 7/2008 | Agur et al. ..... 430/109.4 |
| 2008/0236446 | A1 | 10/2008 | Zhou et al. |
| 2009/0047593 | A1 | 2/2009 | Vanbesien et al. |
| 2009/0149626 | A1 | 6/2009 | DeBruin et al. |
| 2010/0028798 | A1 | 2/2010 | Yoshida et al. |
| 2010/0248122 | A1 | 9/2010 | Sacripante |

* cited by examiner

FOREIGN PATENT DOCUMENTS

JP A-06-128368 5/1994

OTHER PUBLICATIONS

European Patent Office, Search Report dated Aug. 1, 2011 in European Patent Application No. GB11041028.4.

*Primary Examiner* — Stewart Fraser
(74) *Attorney, Agent, or Firm* — Eugene O. Palazzo

(57) ABSTRACT

Embodiments include a toner having a polyester resin derived from diacids and diesters, in combination with at least one diol, in embodiments a cycloaliphatic diol, an optional crystalline resin, an optional colorant, and an optional wax.

15 Claims, No Drawings

POLYESTER RESIN CONTAINING TONER

BACKGROUND

The present disclosure is generally related to toners including polyester resins, and in embodiments, to toners made by emulsion aggregation (EA) and coalescence processes. The toners herein, in embodiments, are environmentally friendly, as they do not use the endocrine disruptor bisphenol A. The toners herein, in embodiments, provide improved carbon/oxygen ratios and, in embodiments, exhibit stable charge and low relative humidity sensitivity.

Emulsion/aggregation/coalescence processes for the preparation of toners are illustrated in a number of patents, the disclosures of each of which are incorporated herein by reference in their entirety, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; 5,977,210; 5,994,020; 6,020,101; 6,130,021; 6,120,967; 6,628,102; 6,664,015; 6,780,560; 6,818,723; 6,824,944; 6,830,860; 6,849,371; 7,208,253; 7,329,476; 7,402,371; 7,416,827; 7,425,398; 7,442,740; and U.S. Patent Application Publication No. 2008/0107989.

Thermal properties are a consideration in the design of a suitable toner. Toners should be designed to help prevent the occurrence of "hot offset." The resin useful in the toner should be amorphous, in embodiments, with a glass transition temperature from about 50° C. to about 65° C., in embodiments from about 52° C. to about 60° C. The softening point, as measured by a Mettler Softening point apparatus, should be from about 108° C. to about 112° C. for high gloss application, or greater than about 125° C. for matte applications.

Many current polyester based toners are derived from the bisphenol A monomer. Bisphenol A has been identified as an endocrine disrupter and possible carcinogen, resulting in adverse developmental health effects. Several European Countries, as well as Canada and several U.S. states, have suggested or implemented a ban of bisphenol A.

Toners that do not use bisphenol-A polyester resins are known, such as those derived from aliphatic glycols and terephthalic acids. Although these resins may provide suitable fusing performance, the toners may display poor electrical performance due to their hydrophilic nature and low carbon/oxygen (C/O) ratio. As a design rule for obtaining good electrical performance, a successful model that has been used in polyester resins is to calculate the C/O ratio of the resin. For example, known toners using bisphenol A and/or styrene based resins have been shown to have a C/O ratio of from about 4.2 to about 5.5. These toners show stable charge and low RH sensitivity. Previous designs using terephthalic-glycol based resins showed a C/O ratio of from about 1.5 to about 2, and displayed poor electrical and RH sensitivity results.

It remains desirable to provide a toner including a polyester resin, which is not derived from the endocrine disruptor bisphenol A. It is further desirable to provide a polyester resin toner which has a suitable glass transition temperature, softening point, C/O ratio, improved electrical characteristics, and RH sensitivity.

SUMMARY

The present disclosure provides toners and processes for making the toners. In embodiments, a toner of the present disclosure may include a polyester resin derived from a first component such as diacids and diesters, in combination with at least one diol such as 2,2-ethyl-butyl-1,3-propanediol, 3-methylpentanediol-(2,4), 2-methylpentanediol-(1,4), 2,4,4-trimethylpentanediol, 2,2,4-trimethylpentane-diol-(1,3), 2-ethylhexanediol-(1,3), 2,2-diethylpropane-diol-(1,3), hexanediol-(1,3), 1,4-di-(hydroxyethoxy)-benzene, 2,2-bis-(4-hydroxycyclohexyl)-propane, 2,4-dihydroxy-1,1,3,3-tetramethyl-cyclobutane, 2,2,4,4-Tetramethyl 1,3-cyclobutanediol, 2,2-bis-(3-hydroxyethoxyphenyl)-propane, 2,2-bis-(4-hydroxypropoxyphenyl)-propane, and combinations thereof; a crystalline resin; an optional colorant; and an optional wax.

In other embodiments, a toner of the present disclosure may include a polyester resin derived from a first component such as diacids and diesters, in combination with at least one diol such as 2,2,4,4-Tetramethyl 1,3-cyclobutanediol, 2,4,4-trimethylpentanediol, 2,4-dihydroxy-1,1,3,3-tetramethyl-cyclobutane, 2,2,4-trimethylpentane-diol-(1,3), and combinations thereof; a crystalline resin; an optional colorant; and an optional wax.

In yet other embodiments, a toner of the present disclosure may include a polyester resin derived from a first component such as terephthalic acid, dimethyl terephthalate, isophthalic acid, dimethyl isophthalate, dimethyl-2,6-naphthalenedicarboxylate, 2,6-naphthalenedicarboxylic acid, ethylene glycol, diethylene glycol, 1,4-cyclohexane-dimethanol, 1,4-butanediol, polytetramethylene glycol, trimellitic anhydride, dimethyl cyclohexane-1,4 dicarboxylate, dimethyl decalin-2,6 dicarboxylate, decalin dimethanol, decahydronaphthalane 2,6-dicarboxylate, 2,6-dihydroxymethyl-decahydronaphthalene, hydroquinone, hydroxybenzoic acid, and combinations thereof, in combination with at least one diol such as 2,2,4,4-Tetramethyl 1,3-cyclobutanediol, 2,4,4-trimethylpentanediol, and combinations thereof; at least one crystalline resin of the following formula:

(IV)

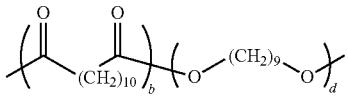

wherein b is from about 5 to about 2000 and d is from about 5 to about 2000; an optional colorant; and an optional wax.

DETAILED DESCRIPTION

In embodiments, there is disclosed toners including polyester resins, and in embodiments, toners made by conventional methods such as melt polycondensation as well as emulsion aggregation (EA) and coalescence processes. The toners herein, in embodiments, are environmentally friendly, as they do not use the endocrine disruptor bisphenol A. The resins herein, in embodiments, provide improved carbon/oxygen ratios and, in embodiments, exhibit stable charge and low relative humidity sensitivity. In embodiments, the toners also include a wax.

Resin

The toner herein includes a resin. The resin herein can be present in various effective amounts, such as from about 70 weight percent to about 98 weight percent, and more specifically, about 80 weight percent to about 92 weight percent, based upon the total weight of the toner.

In embodiments, an esterification reactor and polycondensation reactor may be provided to produce the resin. Monomer is produced in the esterification reactor and is then fed to the polycondensation reactor to produce the polymer resin. In other embodiments, the polycondensation reactor forms an integral unit with the esterification reactor. The reactants are introduced into the esterification portion of the reactor and the final polyester resin product is obtained from the polycondensation portion of the reactor.

The process is applicable for any polyester. Such polyesters include at least one dicarboxylic acid residue and at least one diol residue; in this context residue should be taken in a broad sense, as for example, a dicarboxylic acid residue may be formed using a dicarboxylic acid or via ester exchange using a diester.

In embodiments, suitable dicarboxylic acids include aromatic dicarboxylic acids, in embodiments those having from about 8 to about 14 carbon atoms, in embodiments from about 9 to about 12 carbon atoms, aliphatic dicarboxylic acids having from about 4 to about 12 carbon atoms, or cycloaliphatic dicarboxylic acids having from about 8 to about 12 carbon atoms, in embodiments from about 9 to about 11 carbon atoms. As noted above, in embodiments diesters of these dicarboxylic acids may be used.

Examples of dicarboxylic acids and/or diesters which may be utilized include terephthalic acid, dimethyl terephthalate, 2,6-napthalene dicarboxylic acid, dimethyl-2,6-naphthalenedicarboxylate, 1,4-cyclohexanedicarboxylic acid, cyclohexanediacetic acid, diphenyl-4,4'-dicarboxylic acid, dipheny-3,4'-dicarboxylic acid, 2,2,-dimethyl-1,3-propanediol, 2-dodecenylsuccinic acid, adipic acid, fumaric acid, sebacic acid, phthalic acid, isophthalic acid, dicarboxylic acid, succinic acid, glutaric acid, azelaic acid, trimellitic anhydride, trimellitic acid, combinations thereof, and the like.

Examples of suitable diols which may be utilized in forming the polyester include cycloaliphatic diols having from about 6 to about 20 carbon atoms, in embodiments from about 10 to about 16 carbon atoms, or aliphatic diols having from about 3 to about 20 carbon atoms, in embodiments from about 7 to about 16 carbon atoms. Examples of such diols include ethylene glycol, diethylene glycol, triethylene glycol, dipropylene glycol, ethane diol, butanediol, cyclohexanediol, propylene glycol, propanediol, 2,2-ethyl-butyl-1,3-propanediol, cyclohexanediol, 1,4-cyclohexane-dimethanol, propane-1,3-diol, butane-1,4-diol, pentane-1,5-diol, hexane-1,6-diol, neopentylglycol, 3-methylpentanediol-(2,4), 2-methylpentanediol-(1,4), 2,4,4-trimethylpentanediol, 2,2,4-trimethylpentane-diol-(1,3), 2-ethylhexanediol-(1,3), 2,2-diethylpropane-diol-(1,3), hexanediol-(1,3), 1,4-di-(hydroxyethoxy)-benzene, 2,2-bis-(4-hydroxycyclohexyl)-propane, 2,4-dihydroxy-1,1,3,3-tetramethyl-cyclobutane, 2,2,4,4-Tetramethyl 1,3-cyclobutanediol, 2,2-bis-(3-hydroxyethoxyphenyl)-propane, 2,2-bis-(4-hydroxypropoxyphenyl)-propane, combinations thereof, and the like. Polyesters may be prepared from one or more of the above type diols.

In embodiments, the diol may be 2,2,4,4-Tetramethyl 1,3-cyclobutanediol (TMCD), 2,4,4-trimethylpentanediol (TMPD), 2,2,4-trimethylpentane-diol-(1,3), 2,4-dihydroxy-1,1,3,3-tetramethyl-cyclobutane, or combinations thereof. The structures of some of these diols are set forth as I and II below.

(I)

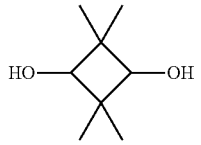

TMCD

-continued (II)

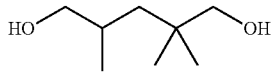

TMPD

In embodiments, suitable comonomers for forming a polyester with TMCD and/or TMPD include terephthalic acid, dimethyl terephthalate, isophthalic acid, dimethyl isophthalate, dimethyl-2,6-naphthalenedicarboxylate, 2,6-naphthalenedicarboxylic acid, ethylene glycol, diethylene glycol, 1,4-cyclohexane-dimethanol (CHDM), 1,4-butanediol, polytetramethylene glycol, trans-DMCD, trimellitic anhydride, dimethyl cyclohexane-1,4 dicarboxylate, dimethyl decalin-2,6 dicarboxylate, decalin dimethanol, decahydronaphthalane 2,6-dicarboxylate, 2,6-dihydroxymethyl-decahydronaphthalene, hydroquinone, hydroxybenzoic acid, combinations thereof, and the like. Bifunctional (A-B type where the ends are not the same) comonomers, such as hydroxybenzoic acid may also be included.

In embodiments, a suitable polyester includes one formed by the reaction of TMPD with dimethyl-2,6-naphthalenedicarboxylate. The structure of this polyester is set forth below as formula III:

(III)

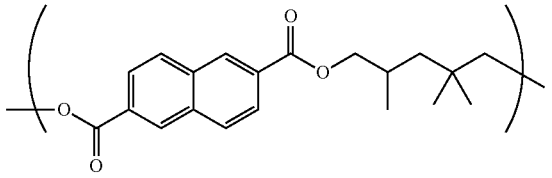

The calculated C/O for this resin is about 5. Other monomers could be added thereto to further adjust the thermal, rheological and C/O values.

In embodiments, it may be desirable to convert hydroxyl end groups on the polyester resin to acid end groups. Specific examples of organic anhydride or acid anhydrides component for converting the polyester resin with hydroxyl end groups to polyester resins with acid end groups include phthalic anhydride, trimellitic anhydride, succinic anhydride, maleic anhydride, glutaric anhydride, 1,2,4,5-benzenedicarboxylic acid anhydride, mixtures thereof and the like, and this component is selected in various effective amounts of, for example, from about 0.5 percent by weight of resin to about 5 percent by weight of resin.

The above polyester resin has a superior C/O ratio of greater than about 4.0, in embodiments from about 4.0 to about 5.5, in embodiments from about 4.5 to about 5. The carbon to oxygen ratio can be easily calculated utilizing the formula;

$$C/O=\Sigma(C_i/O_i)$$

wherein C/O is the carbon to oxygen ratio, Ci is the sum of carbon atoms present in the resin, and Oi is the sum of the oxygen atom present in the resin.

The polyester resin described above is amorphous, and has a glass transition temperature of from about 50° C. to about 70° C., in embodiments from about 52° C. to about 68° C., in embodiments about 65° C.

The polyester resin herein has a softening point, as measured by Mettler Softening point apparatus, of from about 102° C. to about 115° C., or from about 108° C. to about 112° C. for high gloss applications; or greater than about 125° C., or from about 125° C. to about 150° C., or from about 130° C. to about 145° C. for matte applications. A Shimadzu Flowtester for other similar parameters such as Tfl can be used instead of softening point. Rheology can be used to measure Gloss correlation, and to some extent, for Crease MFT.

It has also been found that a polymer with a low acid number may provide desirable characteristics to the toner particles, including good charging performance. For example, the acid number of the polymer may be from about 0 to about 40 mg KOH/g polymer, in embodiments from about 1 to about 30 mg KOH/g polymer, in embodiments from about 5 to about 25 mg KOH/g polymer, in other embodiments about 7 to about 14 mg KOH/g polymer.

The polyester resin herein has a weight average molecular weight (Mw) of from about 2,000 to about 20,000, or from about 2,500 to about 10,000; and a number average molecular weight (Mn) of from about 1,000 to about 10,000, or from about 1,500 to about 7,500.

In embodiments, the amorphous polyester resin described above may be used to form toner particles. The above polyester resin may be used by itself or, in embodiments, it may be combined with at least one crystalline resin to form toner particles. As used herein, "crystalline" refers to a polyester with a three dimensional order. "Semicrystalline resins," as used herein, refers to resins with a crystalline percentage of, for example, from about 10 to about 90%, in embodiments from about 12 to about 70%. Further, as used hereinafter, "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

The crystalline polyester resins, which are available from a number of sources, may possess various melting points of, for example, from about 30° C. to about 120° C., in embodiments from about 50° C. to about 90° C. The crystalline resins may have, for example, a number average molecular weight ($M_n$), as measured by gel permeation chromatography (GPC) of, for example, from about 1,000 to about 50,000, in embodiments from about 2,000 to about 25,000, in embodiments from about 3,000 to about 15,000, and in embodiments from about 6,000 to about 12,000. The weight average molecular weight ($M_w$) of the resin is 50,000 or less, for example, from about 2,000 to about 50,000, in embodiments from about 3,000 to about 40,000, in embodiments from about 10,000 to about 30,000 and in embodiments from about 21,000 to about 24,000, as determined by GPC using polystyrene standards. The molecular weight distribution ($M_w/M_n$) of the crystalline resin is, for example, from about 2 to about 6, in embodiments from about 3 to about 4. The crystalline polyester resins may have an acid value of about 2 to about 20 mg KOH/g polymer, in embodiments from about 5 to about 15 mg KOH/g polymer, and in embodiments from about 8 to about 13 mg KOH/g polymer. The acid value (or neutralization number) is the mass of potassium hydroxide (KOH) in milligrams that is required to neutralize one gram of the crystalline polyester resin.

Illustrative examples of crystalline polyester resins may include any of the various crystalline polyesters, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), polybutylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly(butylene-dodecanedioate), poly(pentylene-dodecanedioate), poly(hexylene-dodecanedioate), poly(octylene-dodecanedioate), poly(nonylene-dodecanedioate), poly(decylene-dodecandioate), poly(undecylene-dodecandioate), poly(dodecylene-dodecandioate), poly(ethylene-fumarate), poly(propylene-fumarate), poly(butylene-fumarate), poly(pentylene-fumarate), poly(hexylene-fumarate), poly(octylene-fumarate), poly(nonylene-fumarate), poly(decylene-fumarate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate) and combinations thereof.

The crystalline resin may be prepared by a polycondensation process by reacting suitable organic diol(s) and suitable organic diacid(s) in the presence of a polycondensation catalyst. Generally, a stoichiometric equimolar ratio of organic diol and organic diacid is utilized, however, in some instances, wherein the boiling point of the organic dial is from about 180° C. to about 230° C., an excess amount of diol can be utilized and removed during the polycondensation process. The amount of catalyst utilized varies, and may be selected in an amount, for example, of from about 0.01 to about 1 mole percent of the resin. Additionally, in place of the organic diacid, an organic diester can also be selected, and where an alcohol byproduct is generated. In further embodiments, the crystalline polyester resin is a poly(dodecandioicacid-co-nonanediol).

Examples of organic diols selected for the preparation of crystalline polyester resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

Suitable crystalline polyester resins include those disclosed in U.S. Pat. No. 7,329,476 and U.S. Patent Application Pub. Nos. 2006/0216626, 2008/0107990, 2008/0236446 and 2009/0047593, each of which is hereby incorporated by reference in their entirety. In embodiments, a suitable crystalline resin may include a resin composed of ethylene glycol or nonanediol and a mixture of dodecanedioic acid and fumaric acid co-monomers with the following formula (IV):

(IV)

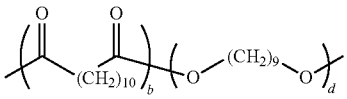

wherein b is from about 5 to about 2000 and d is from about 5 to about 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly(decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly(tetramethylene trithiodicarboxylate), poly(trimethylene dodecane dioate), poly(m-xylene), poly(p-xylylene pimelamide), and combinations thereof.

The amount of the crystalline polyester resin in a toner particle of the present disclosure, whether in the core, any shell present, or both, may be from about 1 to about 15 percent by weight, in embodiments from about 5 to about 10 percent by weight, and in embodiments from about 6 to about 8 percent by weight, of the toner particles (that is, toner particles exclusive of external additives and water).

One, two, or more resins may be used in forming a toner. In embodiments where two or more resins are used, the resins may be in any suitable ratio (e.g., weight ratio) such as, for instance, from about 1% (first resin)/99% (second resin) to about 99% (first resin)/1% (second resin), in embodiments from about 10% (first resin)/90% (second resin) to about 90% (first resin)/10% (second resin).

The amorphous polyester resin may be present in an amount of from about 65 to about 95 percent by weight, or from about 75 to about 85 percent by weight of the toner particles (that is, toner particles exclusive of external additives) on a solids basis. The ratio of crystalline resin to amorphous resin can be in the range from about 1:99 to about 30:70, such as from about 5:95 to about 25:75.

Toner

The polyester resin described above, optionally in combination with a crystalline resin, may be utilized to form toner compositions. The toner can be a polyester toner particle. General emulsion/aggregation (EA) processes for the formation of toners are illustrated in a number of patents, such as U.S. Pat. No. 5,593,807, U.S. Pat. No. 7,402,371, U.S. Patent Application Publication Nos. 2008/0107989 and 2008/0236446, the disclosures of each of which are incorporated herein by reference in their entirety.

Such toner compositions may include optional colorants, waxes, and other additives. Toners may be formed utilizing any method within the purview of those skilled in the art including, but not limited to, emulsion aggregation methods.

Surfactants

In embodiments, the resins described above, as well as any colorants, waxes, and other additives utilized to form toner compositions, may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP604™, NP608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

In addition to the polyester resin, the toners of the present disclosure also optionally contain a wax, which can be either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Optionally, a wax may also be combined with the resin and any colorant utilized in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional wax and any other desired or required additives, and emulsions including the resin(s) described above, optionally in surfactants as described above, and then coalescing the aggregate mixture. A mixture may be prepared by adding an optional wax or other materials, which may also be optionally in a dispersion(s) including a surfactant, to the emulsion, which may be a mixture of two or more emulsions containing more than one resin, or the resin(s) and a wax, colorant, combinations thereof, and the like. The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture, although the amounts can be outside of these ranges. This provides a sufficient amount of agent for aggregation.

The gloss of a toner may be influenced by the amount of retained metal ion, such as $Al^{3+}$, in the particle. The amount of retained metal ion may be further adjusted by the addition of EDTA. In embodiments, the amount of retained crosslinker, for example $Al^{3+}$, in toner particles of the present disclosure may be from about 0.1 pph to about 1 pph, in embodiments from about 0.25 pph to about 0.8 pph, in embodiments about 0.5 pph.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes, although more or less time may be used as desired or required. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Shell Resin

In embodiments, an optional shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be utilized to form a shell over the aggregates to form toner particles having a core-shell configuration.

The shell resin may be present in an amount of from about 20 percent to about 30 percent by weight of the toner particles, in embodiments from about 24 percent to about 28 percent by weight of the toner particles.

Emulsions of the present disclosure including the resins described above and optional additives may possess particles having a size of from about 100 nm to about 260 nm, in embodiments from about 105 nm to about 185 nm.

Emulsions including these resins may have a solids loading of from about 10% solids by weight to about 25% solids by weight, in embodiments from about 12% solids by weight to about 20% solids by weight, in embodiments about 17% solids by weight.

Once the desired final size of the toner particles is achieved, the pH of the mixture may be adjusted with a base to a value of from about 6 to about 10, and in embodiments from about 6.2 to about 7. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 75° C., in embodiments about 70° C., which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours, although periods of time outside of these ranges can be used.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner, although amounts outside these ranges can be used. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with a shell resin described above or after application of the shell resin.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/g to about −45 μC/g, in embodiments from about −10 μC/g to about −40 μC/g, and a final toner charging after surface additive blending of from −10 μC/g to about −45 μC/g.

Utilizing the methods of the present disclosure, desirable gloss levels may be obtained. Thus, for example, the gloss level of a toner of the present disclosure may have a gloss as measured by Gardner Gloss Units (ggu) of from about 20 ggu to about 100 ggu, in embodiments from about 50 ggu to about 95 ggu, in embodiments from about 60 ggu to about 90 ggu.

In embodiments, toners of the present disclosure may be utilized as ultra low melt (ULM) toners. In embodiments, the dry toner particles, exclusive of external surface additives, may have the following characteristics:

(1) Volume average diameter (also referred to as "volume average particle diameter") of from about 2.5 to about 20 microns, in embodiments from about 2.75 to about 10 microns, in other embodiments from about 3 to about 7 microns.

(2) Number Average Geometric Standard Deviation (GSDn) and/or Volume Average Geometric Standard Deviation (GSDv) of from about 1.05 to about 1.55, in embodiments from about 1.1 to about 1.4.

(3) Circularity of from about 0.9 to about 1 (measured with, for example, a Sysmex FPIA 2100 analyzer), in embodiments form about 0.93 to about 0.99, in other embodiments from about 0.95 to about 0.98.

(4) Glass transition temperature of from about 35° C. to about 62° C., in embodiments from about 47° C. to about 60° C.

It may be desirable in embodiments that the toner particle possess separate crystalline polyester and wax melting points and amorphous polyester glass transition temperature as measured by DSC, and that the melting temperatures and glass transition temperature are not substantially depressed by plasticization of the amorphous or crystalline polyesters, or any optional wax. To achieve non-plasticization, it may be desirable to carry out the emulsion aggregation at a coalescence temperature of less than the melting point of the crystalline component and wax components.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser member. The fusing member can be of any desired or suitable configuration, such as a drum or roller, a belt or web, a flat surface or platen, or the like. The fusing member can be applied to the image by any desired or suitable method, such as by passing the final recording substrate through a nip formed by the fusing member and a back member, which can be of any desired or effective configuration, such as a drum or roller, a belt or web, a flat surface or platen, or the like. In embodiments, a fuser roll can be used. Fuser roll members are contact fusing devices that are within the purview of those skilled in the art, in which pressure from the roll, optionally with the application of heat, may be used to fuse the toner to the image-receiving medium. Optionally, a layer of a liquid such as a fuser oil can be applied to the fuser member prior to fusing. In other embodiments, where the toner includes a wax, a fuser oil may not be required.

The following Examples are being submitted to further define various species of the present disclosure. These Examples are intended to be illustrative only and are not intended to limit the scope of the present disclosure. Also, parts and percentages are by weight unless otherwise indicated.

EXAMPLES

Example 1

Synthesis of polyester resin derived from dimethyl-2,6-naphthalenedicarboxylate and 2,4,4-trimethylpentanediol. A 1 liter Parr reactor, equipped with a mechanical stirrer, bottom drain valve, and distillation apparatus, was charged with about 276 grams dimethyl-2,6-naphthalenedicarboxylate, about 245 grams 2,4,4-trimethylpentanediol, about 90 grams propylene glycol, and about 0.6 grams dibutyl tin oxide catalyst (commercially available as FASCAT 4201). The contents were heated to about 165° C. and stirred at about 200 revolutions per minute (rpm) over about a 2 hour period. The temperature was gradually increased to about 190° C. over about a two hour period, and maintained for an additional 2 hours, wherein methanol was collected in the distillation apparatus.

The temperature was then increased to about 200° C., and the pressure reduced to about 0.1 mm-Hg over about a 30 minute period. After an additional two hours, the product was discharged from the vessel. The resulting polyester resin had a glass transition temperature (Tg) of about 65° C.; a number average molecular weight (Mn) of about 1639; a weight average molecular weight (Mw) of about 2867; an acid number of about 12.5; and a softening point of about 122.7° C.

An aqueous emulsion including the above resin at a solids content of about 22% was prepared as follows. The above polyester resin (about 250 grams) was dissolved in about 1.0 liter of ethyl acetate. The dissolved mixture was then added to about 1.4 liters of water containing about 3.4 grams of sodium bicarbonate and about 2.5 grams of sodium dodecylbenzenesulfonate, and the mixture was homogenized for about 20 minutes at about 8000 revolutions per minute (rpm). The ethyl acetate was then removed by distillation, together with some water at from about 80 to about 90° C. with stirring. The aqueous mixture was then cooled to form an emulsion with a solids content of about 22%, and a particle size of about 195 nm.

Example 2

An emulsion aggregation toner was prepared including the polyester resin from Example 1 above and about 3.8% cyan pigment. In a 2 liter reactor vessel, about 376 grams of the polyester of Example 1 in an emulsion (about 22% solids), about 29.2 grams of cyan pigment, Pigment Blue 15:3 (PB 15:3) having a solids loading of about 17 weight %, about 26 grams of 0.3M $HNO_3$, and about 345 grams of deionized water, were added and stirred using an IKA Ultra TURRAX®T50 homogenizer operating at about 4,000 rpm. Thereafter, about 71.685 grams of a flocculent mixture containing about 2.581 grams aluminum sulfate and about 69.104 grams of deionized water was added drop-wise over a period of about 5 minutes. As the flocculent mixture was added drop-wise, the homogenizer speed was increased to about 5,200 rpm and homogenized for an additional 5 minutes.

Thereafter, the mixture was stirred at about 480 rpm and heated at a 1° C. per minute temperature increase to a temperature of about 47° C., and held there for a period of from about 1.5 hours to about 2 hours, resulting in toner particles having a volume average particle diameter of about 7.4 microns as measured with a Coulter Counter. An additional 155 grams of the polyester of Example 1 in an emulsion as described above was added to the reactor mixture and allowed to aggregate for an additional period of about 30 minutes, resulting in toner particles having a volume average particle diameter of about 8.3 microns. The pH of the reactor mixture was adjusted to about 5 with a 1.0 M sodium hydroxide solution, followed by the addition of about 4.6 grams of VERSENE 100 (an ethylene diamine tetraacetic acid (EDTA) chelating agent). The pH of the reactor mixture was then adjusted to about 7.5 with a 1.0 M sodium hydroxide solution, and the stirring was reduced to about 170 rpm. The reactor mixture was then heated at a temperature increase of about 1° C. per minute to a temperature of about 80° C. The pH of the mixture was then adjusted to about 6.8 with a sodium acetate buffer solution. The reactor mixture was then gently stirred at about 85° C. for about 2.5 hours to coalesce and spherodize the particles. The reactor heater was then turned off and the mixture was poured into a container with deionized ice cubes. The resulting toner particles had a volume average particle diameter of about 9.4 microns, and a grain size distribution (GSD) of about 1.21, and a circularity of about 0.980. The particles were washed 3 times with deionized water at room temperature and then freeze-dried.

It will be appreciated that various of the above-discussed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner comprising: a polyester resin derived from a first component selected from the group consisting of diacids and diesters, in combination with at least one diol selected from the group consisting of 2,2-ethyl-butyl-1,3-propanediol, 3-methylpentanediol-(2,4), 2-methylpentanediol-(1,4), 2,4,4-trimethylpentanediol, 2-ethylhexanediol-(1,3), 2,2-bis-(4-hydroxycyclohexyl)-propane, 2,4-dihydroxy-1,1,3,3-tetramethyl-cyclobutane, 2,2-bis-(3-hydroxyethoxyphenyl)-propane, 2,2-bis-(4-hydroxypropoxyphenyl)-propane, and combinations thereof; a crystalline resin wherein said crystalline resin is of the following formula: wherein b is from about 5 to about 2000 and d is from about 5 to about 2000

(IV)

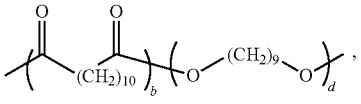

an optional colorant; and an optional wax, wherein said toner is comprised of a core of said polyester resin and a shell of at least one of said polyester resin and said crystalline resin, and wherein said polyester resin has a carbon/oxygen ratio of from about 4 to about 5.5.

2. The toner in accordance with claim 1, wherein the diacid or diester is selected from the group consisting of terephthalic acid, 2,6-naphthalene dicarboxylic acid, dimethyl-2,6-naphthalenedicarboxylate, 1,4-cyclohexanedicarboxylic acid, cyclohexanediacetic acid, diphenyl-4,4'-dicarboxylic acid, dipheny-3,4'-dicarboxylic acid, 2-dodecenylsuccinic acid, adipic acid, fumaric acid, sebacic acid, phthalic acid, isophthalic acid, dicarboxylic acid, succinic acid, glutaric acid, azelaic acid, trimellitic acid, dimethyl terephthalate, and combinations thereof.

3. The toner in accordance with claim 1, wherein the carbon/oxygen ratio is from about 4.5 to about 5.

4. The toner in accordance with claim 1, wherein the glass transition temperature of the polyester resin is from about 50° C. to about 70° C.

5. The toner in accordance with claim 1, wherein the polyester resin has a weight average molecular weight of from about 2,000 to about 20,000, and a number average molecular weight of from about 1,000 to about 10,000.

6. The toner in accordance with claim 1, wherein the polyester resin has a softening point of from about 102° C. to about 115° C.

7. The toner in accordance with claim 1, wherein the polyester resin has a softening point of from about 125° C. to about 150° C.

8. The toner in accordance with claim 1, wherein the polyester resin is of the following formula:

(III)

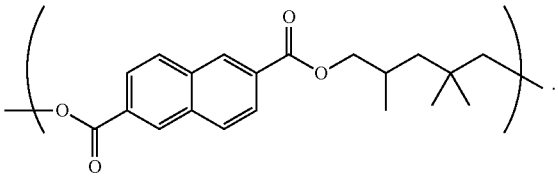

9. A toner consisting of an amorphous polyester resin derived from a first component selected from the group consisting of diacids and diesters, in combination with at least one diol selected from the group consisting of 2,4,4-trimethylpentanediol, 2,4-dihydroxy-1,1,3,3-tetramethyl-cyclobutane, and combinations thereof; a crystalline polyester resin wherein said crystalline polyester resin is of the following formula: wherein b is from about 5 to about 2000 and d is from about 5 to about 2000

(IV)

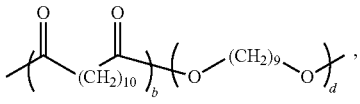

a colorant; optional surface additives, and an optional wax, wherein said toner is comprised of a core of said amorphous polyester resin and a shell of at least one of said amorphous polyester resin and said crystalline polyester resin, wherein said amorphous polyester resin has a weight average molecular weight from about 2,500 to about 10,000 and a number average molecular weight of from about 1,500 to about 7,500, and said amorphous polyester resin has a carbon/oxygen ratio from about 4.5 to about 5.

10. The toner in accordance with claim 9, wherein the first component is selected from the group consisting of terephthalic acid, dimethyl terephthalate, isophthalic acid, dimethyl isophthalate, dimethyl-2,6-napthalenedicarboxylate, 2,6-napthalenedicarboxylic acid, dimethyl cyclohexane-1,4 dicarboxylate, dimethyl decalin-2,6 dicarboxylate, decahydronapthalene 2,6-dicarboxylate, and combinations thereof.

11. The toner in accordance with claim 9, wherein the glass transition temperature of the amorphous polyester resin is from about 52° C. to about 68° C.

12. The toner in accordance with claim 9, wherein the amorphous polyester resin has a softening point of from about of from about 108° C. to about 112° C.

13. The toner in accordance with claim 9, wherein the amorphous polyester resin has a softening point of from about of from about 130° C. to about 145° C.

14. A toner consisting of: a polyester resin derived from a first component selected from the group consisting of terephthalic acid, dimethyl terephthalate, isophthalic acid, dimethyl isophthalate, dimethyl-2,6-napthalenedicarboxylate, 2,6-napthalenedicarboxylic acid, dimethyl cyclohexane-1,4 dicarboxylate, dimethyl decalin-2,6 dicarboxylate, decahydronapthalene 2,6-dicarboxylate, and combinations thereof, in combination with at least one diol selected from the group consisting of 2,2,4,4-Tetramethyl 1,3-cyclobutanediol, 2,4,4-trimethylpentanediol, and combinations thereof; a crystalline resin of the following formula: wherein b is from about 5 to about 2000 and d is from about 5 to about 2000

(IV)

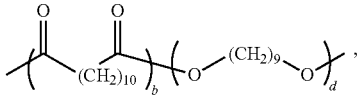

a colorant; an optional wax, wherein said toner is comprised of a core of said polyester resin and a shell of said crystalline resin, said polyester resin has a carbon/oxygen ratio from about 4 to about 5.5 and a glass transition temperature of said polyester resin is from about 50° C. to about 70° C.

15. The toner in accordance with claim 14, wherein the polyester resin has a weight average molecular weight of from about 2,000 to about 20,000, and a number average molecular weight of from about 1,000 to about 10,000.

* * * * *